US011610722B2

(12) United States Patent
Hirukawa

(10) Patent No.: US 11,610,722 B2
(45) Date of Patent: Mar. 21, 2023

(54) MULTILAYER COIL COMPONENT

(71) Applicant: Murata Manufacturing Co., Ltd., Kyoto-fu (JP)

(72) Inventor: Atsuo Hirukawa, Nagaokakyo (JP)

(73) Assignee: Murata Manufacturing Co., Ltd., Kyoto-fu (JP)

( * ) Notice: Subject to any disclaimer, the term of this patent is extended or adjusted under 35 U.S.C. 154(b) by 489 days.

(21) Appl. No.: 16/806,926

(22) Filed: Mar. 2, 2020

(65) Prior Publication Data

US 2020/0286676 A1 Sep. 10, 2020

(30) Foreign Application Priority Data

Mar. 4, 2019 (JP) ..... JP2019-038544

(51) Int. Cl.
*H01F 27/28* (2006.01)
*H01F 41/04* (2006.01)
*H01F 27/29* (2006.01)

(52) U.S. Cl.
CPC ..... *H01F 27/2804* (2013.01); *H01F 27/29* (2013.01); *H01F 41/041* (2013.01); *H01F 2027/2809* (2013.01)

(58) Field of Classification Search
CPC ..... H01F 2027/2809; H01F 41/041; H01F 27/29; H01F 27/2804
See application file for complete search history.

(56) References Cited

U.S. PATENT DOCUMENTS 6,157,285 A 12/2000 Tokuda et al.
6,218,925 B1 * 4/2001 Iwao ..... H01F 27/292 336/200
2017/0154726 A1 * 6/2017 Prager ..... H01F 27/2895

FOREIGN PATENT DOCUMENTS

JP H10-335143 A 12/1998
JP 2001-196240 A 7/2001
JP 2005-072170 A 3/2005
JP 2009-289995 A 12/2009
(Continued)

OTHER PUBLICATIONS

An Office Action; "Notice of Reasons for Refusal," mailed by the Japanese Patent Office dated Oct. 26, 2021, which corresponds to Japanese Patent Application No. 2019-038544 and is related to U.S. Appl. No. 16/806,926 with English translation.

*Primary Examiner* — Hafizur Rahman
*Assistant Examiner* — Kimberly E Glenn
(74) *Attorney, Agent, or Firm* — Studebaker & Brackett PC

(57) ABSTRACT

A multilayer coil component includes a multilayer body formed by stacking a plurality of insulating layers on top of one another and that has a coil built thereinto, and a first outer electrode and a second outer electrode that are electrically connected to the coil. The coil is formed by electrically connecting a plurality of coil conductors. A first main surface of the multilayer body is a mounting surface. A stacking direction of the multilayer body is parallel to the mounting surface. The multilayer coil component includes first and second connection conductors. The first and second connection conductors overlap the coil conductors in a plan view from the stacking direction and are located closer to the mounting surface than a center axis of the coil. Distances between adjacent coil conductors are not constant in a side view from a direction perpendicular to the stacking direction.

4 Claims, 3 Drawing Sheets

(56) References Cited

FOREIGN PATENT DOCUMENTS

| | | | |
|---|---|---|---|
| JP | 2011-109020 | A | 6/2011 |
| JP | 2016-139742 | A | 8/2016 |

* cited by examiner

MULTILAYER COIL COMPONENT

CROSS-REFERENCE TO RELATED APPLICATION

This application claims benefit of priority to Japanese Patent Application No. 2019-038544, filed Mar. 4, 2019, the entire content of which is incorporated herein by reference.

BACKGROUND

Technical Field

The present disclosure relates to a multilayer coil component.

Background Art

As an example of a multilayer coil component, Japanese Unexamined Patent Application Publication No. 2009-289995 discloses an inductor component that includes electrode parts, a winding part, and lead out parts. In the inductor component, changes in impedance can be suppressed and the occurrence of signal reflection can be reduced by monotonically decreasing the winding interval between the turns from one end to the other end of the winding part.

In response to the increasing communication speed and miniaturization of electronic devices in recent years, it is demanded that multilayer inductors have satisfactory radio-frequency characteristics in a radio-frequency band (for example, a GHz band extending from around 30 GHz). However, the radio-frequency characteristics of the inductor component disclosed in Japanese Unexamined Patent Application Publication No. 2009-289995 are not satisfactory when the inductor component is used as a noise absorbing component particularly in a radio-frequency range extending from around 30 GHz. In addition, Japanese Unexamined Patent Application Publication No. 2009-289995 discloses an inductor component that is provided with outer electrodes on the top and bottom surfaces of a multilayer body, in which coil conductors having a planar shape that extends through ½ a turn, are stacked, but there is a problem with the inductor component in that stray capacitances are increased due to the outer electrodes being provided on both the end surfaces and the top and bottom surfaces of the multilayer body and the radio-frequency characteristics are degraded.

SUMMARY

Accordingly, the present disclosure provides a multilayer coil component that has excellent radio-frequency characteristics.

A multilayer coil component according to a preferred embodiment of the present disclosure includes a multilayer body that is formed by stacking a plurality of insulating layers on top of one another and that has a coil built into the inside thereof; and a first outer electrode and a second outer electrode that are electrically connected to the coil. The coil is formed by electrically connecting a plurality of coil conductors, which are stacked together with insulating layers, to one another. The multilayer body has a first end surface and a second end surface, which face each other in a length direction, a first main surface and a second main surface, which face each other in a height direction perpendicular to the length direction, and a first side surface and a second side surface, which face each other in a width direction perpendicular to the length direction and the height direction. The first outer electrode is arranged so as to cover part of the first end surface and so as to extend from the first end surface and cover part of the first main surface. The second outer electrode is arranged so as to cover part of the second end surface and so as to extend from the second end surface and cover part of the first main surface. The first main surface is a mounting surface. A stacking direction of the multilayer body and an axial direction of the coil are parallel to the mounting surface. The multilayer coil component further includes: a first connection conductor and a second connection conductor inside the multilayer body. The first connection conductor is connected in a straight line between a part of the first outer electrode that covers the first end surface and the coil conductor that faces the first outer electrode. The second connection conductor is connected in a straight line between a part of the second outer electrode that covers the second end surface and the coil conductor that faces the second outer electrode. The first connection conductor and the second connection conductor overlap the coil conductors in a plan view from the stacking direction and are located closer to the mounting surface than a center axis of the coil. The coil conductors overlap in a plan view from the stacking direction. Distances between adjacent coil conductors are not constant in a side view from a direction perpendicular to the stacking direction.

According to the preferred embodiment of the present disclosure, a multilayer coil component can be provided that has excellent radio-frequency characteristics.

Other features, elements, characteristics and advantages of the present disclosure will become more apparent from the following detailed description of preferred embodiments of the present disclosure with reference to the attached drawings.

DETAILED DESCRIPTION

Hereafter, a multilayer coil component according to an embodiment of the present disclosure will be described. However, the present disclosure is not limited to the following embodiment and the present disclosure can be applied with appropriate modifications within a range that does not alter the gist of the present disclosure. Combinations consisting of two or more desired configurations among the configurations described below are also included in the scope of the present disclosure.

Figure 1:
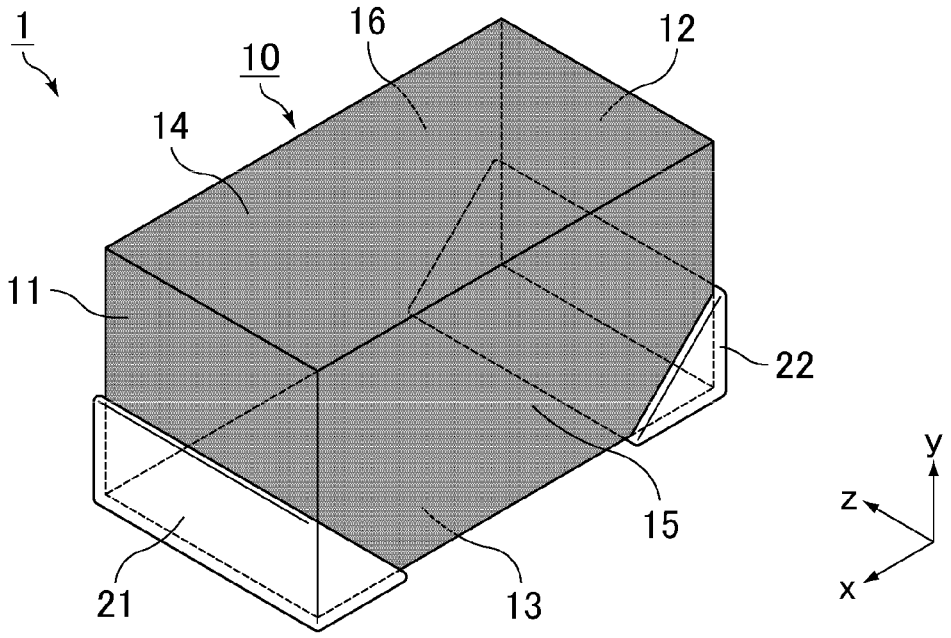
FIG. 1 is a perspective view schematically illustrating a multilayer coil component according to an embodiment of the present disclosure.
Figure 2A:
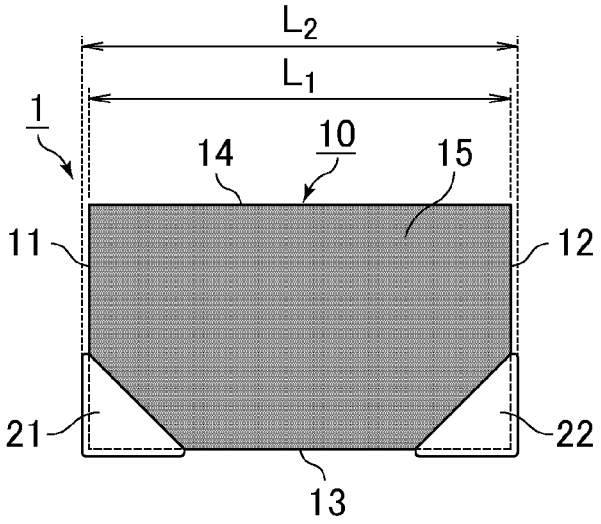
FIG. 2A is a side view of the multilayer coil component illustrated in FIG. 1.
Figure 2B:
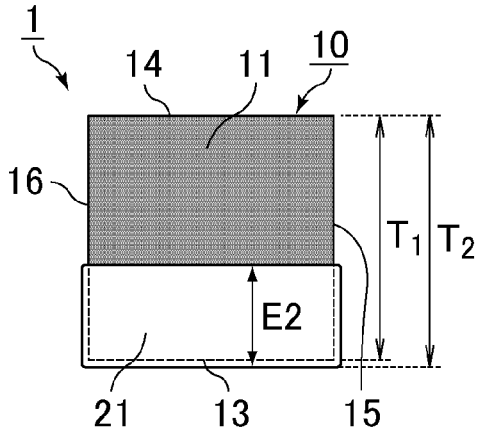
FIG. 2B is a front view of the multilayer coil component illustrated in FIG. 1.
Figure 2C:
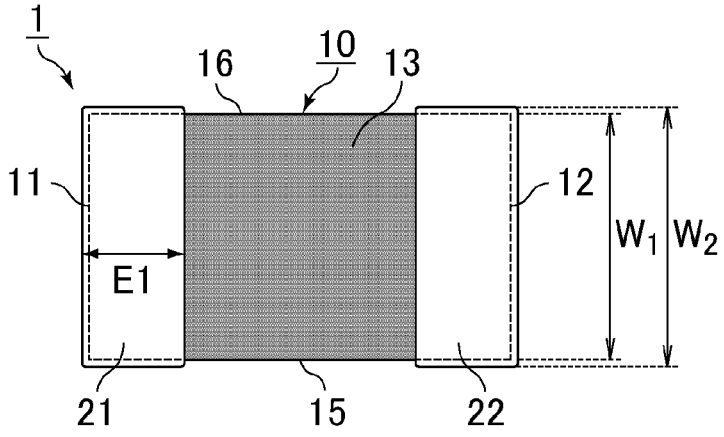
FIG. 2C is a bottom view of the multilayer coil component illustrated in FIG. 1.

FIG. 1 is a perspective view schematically illustrating a multilayer coil component according to an embodiment of the present disclosure. FIG. 2A is a side view of the multilayer coil component illustrated in FIG. 1, FIG. 2B is a front view of the multilayer coil component illustrated in FIG. 1, and FIG. 2C is a bottom view of the multilayer coil component illustrated in FIG. 1.

A multilayer coil component 1 illustrated in FIGS. 1, 2A, 2B, and 2C includes a multilayer body 10, a first outer electrode 21, and a second outer electrode 22. The multilayer body 10 has a substantially rectangular parallelepiped shape having six surfaces. The configuration of the multilayer body 10 will be described later, but the multilayer body 10 is formed by stacking a plurality of insulating layers on top of one another and has a coil built into the inside thereof. The first outer electrode 21 and the second outer electrode 22 are electrically connected to the coil.

In the multilayer coil component 1 and the multilayer body 10 of the embodiment of the present disclosure, a length direction, a height direction, and a width direction are an x direction, a y direction, and a z direction, respectively, in FIG. 1. Here, the length direction (x direction), the height direction (y direction), and a width direction (z direction) are perpendicular to each other.

As illustrated in FIGS. 1, 2A, 2B, and 2C, the multilayer body 10 has a first end surface 11 and a second end surface 12, which face each other in the length direction (x direction), a first main surface 13 and a second main surface 14, which face each other in the height direction (y direction) perpendicular to the length direction, and a first side surface 15 and a second side surface 16, which face each other in the width direction (z direction) perpendicular to the length direction and the height direction.

Although not illustrated in FIG. 1, corner portions and edge portions of the multilayer body 10 are preferably rounded. The term "corner portion" refers to a part of the multilayer body 10 where three surfaces intersect and the term "edge portion" refers to a part of the multilayer body 10 where two surfaces intersect.

The first outer electrode 21 is arranged so as to cover part of the first end surface 11 of the multilayer body 10 as illustrated in FIGS. 1 and 2B and so as to extend from the first end surface 11 and cover part of the first main surface 13 of the multilayer body 10, as illustrated in FIGS. 1 and 2C. As illustrated in FIG. 2B, the first outer electrode 21 covers a region of the first end surface 11 that includes the edge portion that intersects the first main surface 13, but does not cover a region of the first end surface 11 that includes the edge portion that intersects the second main surface 14. Therefore, the first end surface 11 is exposed in the region including the edge portion that intersects the second main surface 14. In addition, the first outer electrode 21 does not cover the second main surface 14. Since part of the first end surface 11 is not covered by the first outer electrode 21, stray capacitances can be reduced and radio-frequency characteristics can be improved compared with a multilayer coil component in which the entire first end surface is covered by the first outer electrode.

In FIG. 2B, a height E2 of the part of the first outer electrode 21 that covers the first end surface 11 of the multilayer body 10 is constant, but the shape of the first outer electrode 21 is not particularly limited so long as the first outer electrode 21 covers part of the first end surface 11 of the multilayer body 10. For example, the first outer electrode 21 may have an arch-like shape that increases in height from the ends thereof toward the center thereof on the first end surface 11 of the multilayer body 10. In addition, in FIG. 2C, a length E1 of the part of the first outer electrode 21 that covers the first main surface 13 of the multilayer body 10 is constant, but the shape of the first outer electrode 21 is not particularly limited so long as the first outer electrode 21 covers part of the first main surface 13 of the multilayer body 10. For example, the first outer electrode 21 may have an arch-like shape that increases in length from the ends thereof toward the center thereof on the first main surface 13 of the multilayer body 10.

As illustrated in FIGS. 1 and 2A, the first outer electrode 21 may be additionally arranged so as to extend from the first end surface 11 and the first main surface 13 and cover part of the first side surface 15 and part of the second side surface 16. In this case, as illustrated in FIG. 2A, the parts of the first outer electrode 21 covering the first side surface 15 and the second side surface 16 are preferably formed in a diagonal shape relative to both the edge portion that intersects the first end surface 11 and the edge portion that intersects the first main surface 13. However, the first outer electrode 21 does not have to be arranged so as to cover part of the first side surface 15 and part of the second side surface 16.

The second outer electrode 22 is arranged so as to cover part of the second end surface 12 of the multilayer body 10 and so as to extend from the second end surface 12 and cover part of the first main surface 13 of the multilayer body 10. Similarly to the first outer electrode 21, the second outer electrode 22 covers a region of the second end surface 12 that includes the edge portion that intersects the first main surface 13, but does not cover a region of the second end surface 12 that includes the edge portion that intersects the second main surface 14. Therefore, the second end surface 12 is exposed in the region including the edge portion that intersects the second main surface 14. In addition, the second outer electrode 22 does not cover the second main surface 14. Since part of the second end surface 12 is not covered by the second outer electrode 22, stray capacitances can be reduced and radio-frequency characteristics can be improved compared with a multilayer coil component in which the entire second end surface is covered by the second outer electrode.

Similarly to the first outer electrode 21, the shape of the second outer electrode 22 is not particularly limited so long as the second outer electrode 22 covers part of the second end surface 12 of the multilayer body 10. For example, the second outer electrode 22 may have an arch-like shape that increases in height from the ends thereof toward the center thereof on the second end surface 12 of the multilayer body 10. Furthermore, the shape of the second outer electrode 22 is not particularly limited so long as the second outer electrode 22 covers part of the first main surface 13 of the multilayer body 10. For example, the second outer electrode 22 may have an arch-like shape that increases in length from the ends thereof toward the center thereof on the first main surface 13 of the multilayer body 10.

Similarly to the first outer electrode 21, the second outer electrode 22 may be additionally arranged so as to extend from the second end surface 12 and the first main surface 13 and cover part of the first side surface 15 and part of the second side surface 16. In this case, the parts of the second outer electrode 22 covering the first side surface 15 and the second side surface 16 are preferably formed in a diagonal shape relative to both the edge portion that intersects the second end surface 12 and the edge portion that intersects the first main surface 13. However, the second outer electrode 22 does not have to be arranged so as to cover part of the first side surface 15 and part of the second side surface 16.

The first outer electrode 21 and the second outer electrode 22 are arranged in the manner described above, and therefore the first main surface 13 of the multilayer body 10 serves as a mounting surface when the multilayer coil component 1 is mounted on a substrate.

Although the size of the multilayer coil component 1 according to the embodiment of the present disclosure is not particularly limited, the multilayer coil component 1 is preferably the 0603 size, the 0402 size, or the 1005 size.

In the case where the multilayer coil component 1 according to the embodiment of the present disclosure is the 0603 size, the length of the multilayer body 10 (length indicated by double-headed arrow $L_1$ in FIG. 2A) preferably lies in a range of around 0.57 mm to 0.63 mm. In the case where the multilayer coil component 1 according to the embodiment of the present disclosure is the 0603 size, the width of the multilayer body 10 (length indicated by double-headed arrow $W_1$ in FIG. 2C) preferably lies in a range of around 0.27 mm to 0.33 mm. In the case where the multilayer coil component 1 according to the embodiment of the present disclosure is the 0603 size, the height of the multilayer body 10 (length indicated by double-headed arrow $T_1$ in FIG. 2B) preferably lies in a range of around 0.27 mm to 0.33 mm.

In the case where the multilayer coil component 1 according to the embodiment of the present disclosure is the 0603 size, the length of the multilayer coil component 1 (length indicated by double arrow $L_2$ in FIG. 2A) preferably lies in a range of around 0.57 mm to 0.63 mm. In the case where the multilayer coil component 1 according to the embodiment of the present disclosure is the 0603 size, the width of the multilayer coil component 1 (length indicated by double-headed arrow $W_2$ in FIG. 2C) preferably lies in a range of around 0.27 mm to 0.33 mm. In the case where the multilayer coil component 1 according to the embodiment of the present disclosure is the 0603 size, the height of the multilayer coil component 1 (length indicated by double-headed arrow $T_2$ in FIG. 2B) preferably lies in a range of around 0.27 mm to 0.33 mm.

In the case where the multilayer coil component 1 according to the embodiment of the present disclosure is the 0603 size, the length of the part of the first outer electrode 21 that covers the first main surface 13 of the multilayer body 10 (length indicated by double-headed arrow E1 in FIG. 2C) preferably lies in a range of around 0.12 mm to 0.22 mm. Similarly, the length of the part of the second outer electrode 22 that covers the first main surface 13 of the multilayer body 10 preferably lies in a range of around 0.12 mm to 0.22 mm Additionally, in the case where the length of the part of the first outer electrode 21 that covers the first main surface 13 of the multilayer body 10 and the length of the part of the second outer electrode 22 that covers the first main surface 13 of the multilayer body 10 are not constant, it is preferable that the lengths of the longest parts thereof lie within the above-described range.

In the case where the multilayer coil component 1 according to the embodiment of the present disclosure is the 0603 size, the height of the part of the first outer electrode 21 that covers the first end surface 11 of the multilayer body 10 (length indicated by double-headed arrow E2 in FIG. 2B) preferably lies in a range of around 0.10 mm to 0.20 mm. Similarly, the height of the part of the second outer electrode 22 that covers the second end surface 12 of the multilayer body 10 preferably lies in a range of around 0.10 mm to 0.20 mm. In this case, stray capacitances arising from the outer electrodes 21 and 22 can be reduced. In the case where the height of the part of the first outer electrode 21 that covers the first end surface 11 of the multilayer body 10 and the height of the part of the second outer electrode 22 that covers the second end surface 12 of the multilayer body 10 are not constant, it is preferable that the heights of the highest parts thereof lie within the above-described range.

In the case where the multilayer coil component 1 according to the embodiment of the present disclosure is the 0402 size, the length of the multilayer body 10 preferably lies in a range of around 0.38 mm to 0.42 mm and the width of the multilayer body 10 preferably lies in a range of around 0.18 mm to 0.22 mm. In the case where the multilayer coil component 1 according to the embodiment of the present disclosure is the 0402 size, the height of the multilayer body 10 preferably lies in a range of around 0.18 mm to 0.22 mm.

In the case where the multilayer coil component 1 according to the embodiment of the present disclosure is the 0402 size, the length of the multilayer coil component 1 preferably lies in a range of around 0.38 mm to 0.42 mm. In the case where the multilayer coil component 1 according to the embodiment of the present disclosure is the 0402 size, the width of the multilayer coil component 1 preferably lies in a range of around 0.18 mm to 0.22 mm. In the case where the multilayer coil component 1 according to the embodiment of the present disclosure is the 0402 size, the height of the multilayer coil component 1 preferably lies in a range of around 0.18 mm to 0.22 mm.

In the case where the multilayer coil component 1 according to the embodiment of the present disclosure is the 0402 size, the length of the part of the first outer electrode 21 that covers the first main surface 13 of the multilayer body 10 preferably lies in a range of around 0.08 mm to 0.15 mm. Similarly, the length of the part of the second outer electrode 22 that covers the first main surface 13 of the multilayer body 10 preferably lies in a range of around 0.08 mm to 0.15 mm.

In the case where the multilayer coil component 1 according to the embodiment of the present disclosure is the 0402 size, the height of the part of the first outer electrode 21 that covers the first end surface 11 of the multilayer body 10 preferably lies in a range of around 0.06 mm to 0.13 mm. Similarly, the height of the part of the second outer electrode 22 that covers the second end surface 12 of the multilayer body 10 preferably lies in a range of around 0.06 mm to 0.13 mm. In this case, stray capacitances arising from the outer electrodes 21 and 22 can be reduced.

In the case where the multilayer coil component 1 according to the embodiment of the present disclosure is the 1005 size, the length of the multilayer body 10 preferably lies in a range of around 0.95 mm to 1.05 mm and the width of the multilayer body 10 preferably lies in a range of around 0.45 mm to 0.55 mm. In the case where the multilayer coil component 1 according to the embodiment of the present disclosure is the 1005 size, the height of the multilayer body 10 preferably lies in a range of around 0.45 mm to 0.55 mm.

In the case where the multilayer coil component 1 according to the embodiment of the present disclosure is the 1005 size, the length of the multilayer coil component 1 preferably lies in a range of around 0.95 mm to 1.05 mm. In the case where the multilayer coil component 1 according to the embodiment of the present disclosure is the 1005 size, the width of the multilayer coil component 1 preferably lies in a range of around 0.45 mm to 0.55 mm. In the case where the multilayer coil component 1 according to the embodiment of the present disclosure is the 1005 size, the height of the multilayer coil component 1 preferably lies in a range of around 0.45 mm to 0.55 mm.

In the case where the multilayer coil component 1 according to the embodiment of the present disclosure is the 1005 size, the length of the part of the first outer electrode 21 that covers the first main surface 13 of the multilayer body 10 preferably lies in a range of around 0.20 mm to 0.38 mm. Similarly, the length of the part of the second outer electrode 22 that covers the first main surface 13 of the multilayer body 10 preferably lies in a range of around 0.20 mm to 0.38 mm.

In the case where the multilayer coil component 1 according to the embodiment of the present disclosure is the 1005 size, the height of the part of the first outer electrode 21 that covers the first end surface 11 of the multilayer body 10 preferably lies in a range of around 0.15 mm to 0.33 mm. Similarly, the height of the part of the second outer electrode 22 that covers the second end surface 12 of the multilayer body 10 preferably lies in a range of around 0.15 mm to 0.33 mm. In this case, stray capacitances arising from the outer electrodes 21 and 22 can be reduced.

The coil that is built into the multilayer body 10 of the multilayer coil component 1 according to the embodiment of the present disclosure will be described next. The coil is formed by electrically connecting a plurality of coil conductors, which are stacked together with insulating layers, to one another.

Figure 3:
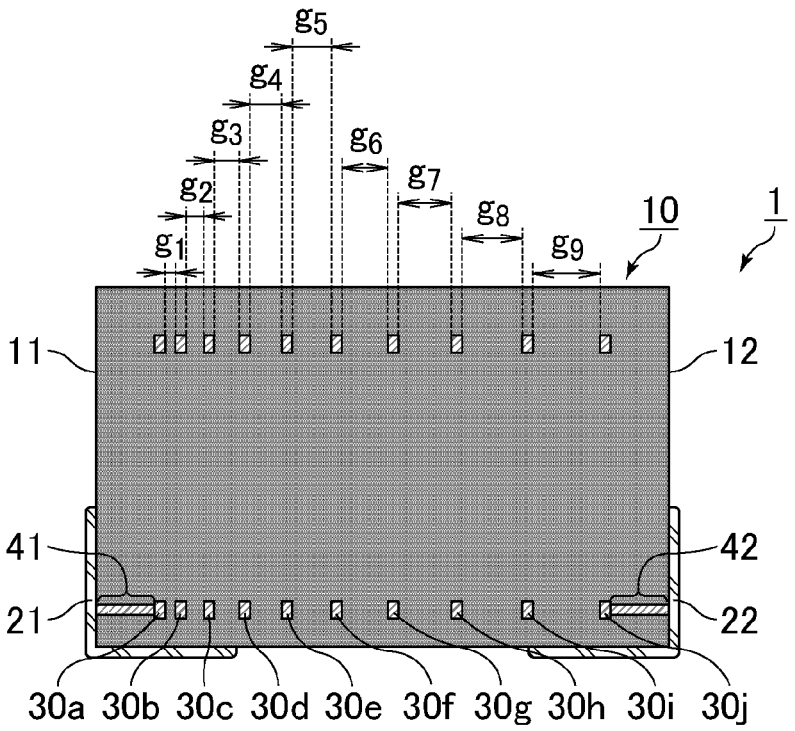
FIG. 3 is a sectional view of the multilayer coil component illustrated in FIG. 1.

FIG. 3 is a sectional view of the multilayer coil component 1 illustrated in FIG. 1. As illustrated in FIG. 3, the multilayer body 10 of the multilayer coil component 1 includes coil conductors 30*a*, 30*b*, 30*c*, 30*d*, 30*e*, 30*f*, 30*g*, 30*h*, 30*i*, and 30*j*. The coil conductors 30*a*, 30*b*, 30*c*, 30*d*, 30*e*, 30*f*, 30*g*, 30*h*, 30*i*, and 30*j* are coil conductors having the same shape, and the coil conductors overlap one another in a plan view from the stacking direction.

The distance between the coil conductor 30*a* and the coil conductor 30*b* is the length indicated by a double-headed arrow $g_1$. The distance between the coil conductor 30*b* and the coil conductor 30*c* is the length indicated by a double-headed arrow $g_2$. The distance between the coil conductor 30*c* and the coil conductor 30*d* is the length indicated by a double-headed arrow $g_3$. The distance between the coil conductor 30*d* and the coil conductor 30*e* is the length indicated by a double-headed arrow $g_4$. The distance between the coil conductor 30*e* and the coil conductor 30*f* is the length indicated by a double-headed arrow $g_5$. The distance between the coil conductor 30*f* and the coil conductor 30*g* is the length indicated by a double-headed arrow $g_6$. The distance between the coil conductor 30*g* and the coil conductor 30*h* is the length indicated by a double-headed arrow $g_7$. The distance between the coil conductor 30*h* and the coil conductor 30*i* is the length indicated by a double-headed arrow $g_5$. The distance between the coil conductor 30*i* and the coil conductor 30*j* is the length indicated by a double-headed arrow g9. As is clear from FIG. 3, the relationship $g_1<g_2<g_3<g_4<g_5<g_6<g_7<g_8<g_9$ exists between the distances between the coil conductors. Therefore, in the multilayer coil component 1 according to the embodiment of the present disclosure, the distance between the coil conductors is not constant in a side view from a direction perpendicular to the stacking direction. The distance between the coil conductors increases in a direction from the first end surface 11 toward the second end surface 12. A stray capacitance is proportional to the square of the distance between the coil conductors. Therefore, when the distances between adjacent coil conductors are not constant, the stray capacitances between the coil conductors vary and the peak of a resonant frequency is lowered, and therefore the radio-frequency characteristics can be improved. Furthermore, the coupling coefficients between the coil conductors also change with the varying distances between the coil conductors and consequently the radio-frequency characteristics can be improved.

In addition, in the multilayer coil component 1 illustrated in FIG. 3, the first outer electrode 21 and the coil conductor that faces the first outer electrode 21 are connected to each other in a straight line by a first connection conductor 41 and the second outer electrode 22 and the coil conductor that faces the second outer electrode 22 are connected to each other in a straight line by a second connection conductor 42. The first connection conductor 41 and the second connection conductor 42 are connected to the respective coil conductors at the parts of the coil conductors that are closest to the first main surface 13, which is the mounting surface. The first connection conductor 41 and the second connection conductor 42 overlap the coil conductors in a plan view from the stacking direction and are positioned closer to the first main surface 13, which is the mounting surface, than the center axis of the coil. Since the first connection conductor 41 and the second connection conductor 42 are both connected to the coil conductors at the parts of the coil conductors that are closest to the mounting surface, the outer electrodes can be reduced in size and the radio-frequency characteristics can be improved.

In the multilayer coil component 1 according to the embodiment of the present disclosure, the distance between the coil conductors is not constant in a side view from a direction perpendicular to the stacking direction. "The distance between the coil conductors is constant" means that the distances between all the coil conductors are identical, that is, there is only one distance between adjacent coil conductors.

Regarding the arrangement of the coil conductors in the multilayer coil component 1 according to the embodiment of the present disclosure, provided that there are at least two different distances between adjacent coil conductors, there may be places where there are identical distances between adjacent coil conductors and these places where there are identical distances between adjacent coil conductors may be located next to each other. For example, the coil conductors may be arranged in an order so that the distances between the coil conductors increases in a direction from the first end surface 11 toward the second end surface 12 as illustrated in FIG. 3, or conversely the coil conductors may be arranged in an order so that the distances between the coil conductors decreases in a direction from the first end surface 11 toward the second end surface 12. Furthermore, the coil conductors may be arranged so that the distances therebetween initially increase in a direction from the first end surface 11 toward the second end surface 12 and then decrease after a midway point. The distances between the coil conductors may be arranged in a regular manner or may be randomly arranged.

In this specification, "the distance between coil conductors" refers to the distance between coil conductors formed on coil sheets used when manufacturing the multilayer body 10 (i.e., the thickness of an insulating layer) and does not refer to the physical distance in the stacking direction between conductors constituting the coil. Therefore, the distance between coil conductors may also be said to be the length of a via conductor connecting the coil conductors to each other in the stacking direction. In the multilayer coil component 1 according to the embodiment of the present disclosure, the lengths of via conductors connecting the coil conductors to each other are not constant.

The shape of the coil conductors is not particularly limited and may be a substantially circular or polygonal shape. In the case where the shape of the coil conductors is a substantially polygonal shape, the coil diameter is the diameter of an area-equivalent circle of the polygonal shape.

In the case where the multilayer coil component 1 according to the embodiment of the present disclosure is the 0603 size, the inner diameter of the coil conductors preferably lies in a range of around 50 μm to 100 μm.

In the case where the multilayer coil component 1 according to the embodiment of the present disclosure is the 0402 size, the inner diameter of the coil conductors preferably lies in a range of around 30 μm to 70 μm.

In the case where the multilayer coil component 1 according to the embodiment of the present disclosure is the 1005 size, the inner diameter of the coil conductors preferably lies in a range of around 80 μm to 170 μm.

The line width of the coil conductors in a plan view from the stacking direction is not particularly limited but is preferably in a range of around 10% to 30% of the width of the multilayer body 10. When the line width of the coil conductors is less than around 10% of the width of the multilayer body 10, a direct-current resistance Rdc may become large. On the other hand, when the line width of the coil conductors exceeds around 30% of the width of the multilayer body 10, the electrostatic capacitance of the coil may become large and the radio-frequency characteristics may be degraded.

In the case where the multilayer coil component 1 according to the embodiment of the present disclosure is the 0603 size, the line width of the coil conductors preferably lies in a range of around 30 μm to 90 μm and more preferably lies in a range of around 30 μm to 70 μm.

In the case where the multilayer coil component 1 according to the embodiment of the present disclosure is the 0402 size, the line width of the coil conductors preferably lies in a range of around 20 μm to 60 μm and more preferably lies in a range of around 20 μm to 50 μm.

In the case where the multilayer coil component 1 according to the embodiment of the present disclosure is the 1005 size, the line width of the coil conductors preferably lies in a range of around 50 μm to 150 μm and more preferably lies in a range of around 50 μm to 120 μm.

The inner diameter of the coil conductors in a plan view from the stacking direction is preferably in a range of around 15% to 40% of the width of the multilayer body 10.

The inter coil conductor distance in the stacking direction preferably lies in a range of around 3 μm to 21 μm in the multilayer coil component 1 according to the embodiment of the present disclosure. As a result of making the inter coil conductor distance in the stacking direction lie in a range of around 3 μm to 21 μm, the number of turns of the coil can be increased and therefore the impedance can be increased. In addition, the transmission coefficient S21 in a radio-frequency band can also be increased as described later and stray capacitances between electrodes can be reduced.

A first connection conductor and a second connection conductor are provided inside the multilayer body 10 of the multilayer coil component 1. The first connection conductor and the second connection conductor are each shaped so as to be connected in a straight line between an outer electrode and a coil conductor. By connecting the first connection conductor and the second connection conductor from the coil conductors to the outer electrodes in straight lines, lead out parts can be simplified and the radio-frequency characteristics can be improved.

The length of the multilayer body 10 in the length direction is the sum of the lengths of the coil, the first connection conductor, and the second connection conductor. Here, the length of the coil in the length direction preferably lies in a range of around 85.0% to 94.0% of the length of the multilayer body 10.

In the case where the multilayer coil component 1 according to the embodiment of the present disclosure is the 0603 size, the lengths of the first connection conductor and the second connection conductor preferably lie in a range of around 15 μm to 45 μm and more preferably lie in a range of around 15 μm to 30 μm.

In the case where the multilayer coil component 1 according to the embodiment of the present disclosure is the 0402 size, the lengths of the first connection conductor and the second connection conductor preferably lie in a range of around 10 μm to 30 μm and more preferably lie in a range of around 10 μm to 25 μm.

In the case where the multilayer coil component 1 according to the embodiment of the present disclosure is the 1005 size, the lengths of the first connection conductor and the second connection conductor preferably lie in a range of around 25 μm to 75 μm and more preferably lie in a range of around 25 μm to 50 μm.

Provided that via conductors forming a connection conductor overlap in a plan view from the stacking direction, the via conductors forming the connection conductor do not have to be precisely aligned in a straight line.

The width of the first connection conductor and the width of the second connection conductor preferably each lie in a range of around 8% to 20% of the width of the multilayer body 10. The "width of the connection conductor" refers to the width of the narrowest part of the connection conductor. That is, when a connection conductor includes a land, the shape of the connection conductor is the shape obtained by removing the land.

In the case where the multilayer coil component 1 according to the embodiment of the present disclosure is the 0603 size, the widths of the connection conductors preferably lie in a range of around 30 μm to 60 μm.

In the case where the multilayer coil component 1 according to the embodiment of the present disclosure is the 0402 size, the widths of the connection conductors preferably lie in a range of around 20 μm to 40 μm.

In the case where the multilayer coil component 1 according to the embodiment of the present disclosure is the 1005 size, the widths of the connection conductors preferably lie in a range of around 40 μm to 100 μm.

In the multilayer coil component 1 according to the embodiment of the present disclosure, the lengths of the first connection conductor and the second connection conductor preferably lie in a range of around 2.5% to 7.5% of the length of the multilayer body 10, more preferably in a range of around 3.0% to 7.5% of the length of the multilayer body 10, and still more preferably in a range of around 3.0% to 5.0% of the length of the multilayer body 10.

In the multilayer coil component 1 according to the embodiment of the present disclosure, there may be two or more of the first connection conductor and the second connection conductor. A case where there are two or more connection conductors indicates a state where a part of an outer electrode covering an end surface and the coil conductor facing that outer electrode are connected to each other in at least two places by the connection conductors.

The multilayer coil component 1 according to the embodiment of the present disclosure has excellent radio-frequency characteristics in a radio-frequency band (in particular, in a range of around 30 GHz to 80 GHz). Specifically, the transmission coefficient S21 at 40 GHz preferably lies in a range of around −1 dB to 0 dB and the transmission coefficient S21 at 50 GHz preferably lies in a range of around −2 dB to 0 dB. The transmission coefficient S21 is obtained from a ratio of the power of a transmitted signal to the power of an input signal. The transmission coefficient S21 is basically a dimensionless quantity, but is usually expressed in dB using the common logarithm. When the above conditions are satisfied, for example, the multilayer coil component 1 can be suitably used in a bias tee circuit or the like inside an optical communication circuit.

Hereafter, an example of a method of manufacturing the multilayer coil component 1 according to the embodiment of the present disclosure will be described.

First, ceramic green sheets, which are insulating layers, are manufactured. For example, an organic binder such as a polyvinyl butyral resin, an organic solvent such as ethanol or toluene, and a dispersant are added to a ferrite raw material and kneaded to form a slurry. After that, magnetic sheets having a thickness of around 12 μm are obtained using a method such as a doctor blade technique.

As a ferrite raw material, for example, iron, nickel, zinc and copper oxide raw materials are mixed together and calcined at around 800° C. for around one hour, pulverized using a ball mill, and dried, and a Ni—Zn—Cu ferrite raw material (oxide mixed powder) having an average particle diameter of around 2 μm can be obtained.

As a ceramic green sheet material, which forms the insulating layers, for example, a magnetic material such as a ferrite material, a nonmagnetic material such as a glass ceramic material, or a mixed material obtained by mixing a magnetic material and a nonmagnetic material can be used. When manufacturing ceramic green sheets using a ferrite material, in order to obtain a high L value (inductance), it is preferable to use a ferrite material having a composition consisting of $Fe_2O_3$ at around 40 mol % to 49.5 mol %, ZnO at around 5 mol % to 35 mol %, CuO at around 4 mol % to 12 mol %, and the remainder consisting of NiO and trace amounts of additives (including inevitable impurities).

Via holes having a diameter of around 20 μm to 30 μm are formed by subjecting the manufactured ceramic green sheets to prescribed laser processing. Using a Ag paste on specific sheets having via holes, the coil sheets are formed by filling the via holes and screen-printing prescribed coil-looping conductor patterns (coil conductors) having a thickness of around 11 μm and drying.

The thicknesses of the ceramic green sheets forming the coil sheets are preferably appropriately chosen in accordance with the desired distances between the coil conductors. The distances between the coil conductors can be adjusted by adjusting the thicknesses of the ceramic green sheets. In addition, the distances between the coil conductors can also be adjusted by using a method in which via sheets, in which via conductors are formed, are stacked between the coil sheets and the number and/or thicknesses of the via sheets are adjusted rather than by adjusting the thicknesses of the ceramic green sheets.

The coil sheets are stacked in an order so that a coil having a looping axis in a direction parallel to the mounting surface is formed in the multilayer body and so that there are desired distances between the coil conductors after division into individual components. In addition, via sheets, in which via conductors serving as connection conductors are formed, are stacked above and below the coil sheets. At this time, the quantities and thicknesses of the coil sheets and via sheets are preferably adjusted so that the lengths of the connection conductors both lie in a range of around 3.0% to 7.5% of the length of the multilayer body 10.

The multilayer body is subjected to thermal pressure bonding in order to obtain a pressure-bonded body, and then the pressure-bonded body is cut into pieces of a predetermined chip size to obtain individual chips. The divided chips may be processed using a rotary barrel in order to round the corner portions and edge portions thereof.

Binder removal and firing is performed at a predetermined temperature and for a predetermined period of time, and fired bodies (multilayer bodies) having a built-in coil are obtained.

The chips are dipped at an angle in a layer obtained by spreading a Ag paste to a predetermined thickness and baked to form a base electrode for an outer electrode on four surfaces (a main surface, an end surface, and both side surfaces) of the multilayer body. In the above-described method, the base electrode can be formed in one go in contrast to the case where the base electrode is formed separately on the main surface and the end surface of the multilayer body in two steps.

Formation of the outer electrodes is completed by sequentially forming a Ni film and a Sn film having predetermined thicknesses on the base electrodes by performing plating. The multilayer coil component 1 according to the embodiment of the present disclosure can be manufactured as described above.

While preferred embodiments of the disclosure have been described above, it is to be understood that variations and modifications will be apparent to those skilled in the art without departing from the scope and spirit of the disclosure. The scope of the disclosure, therefore, is to be determined solely by the following claims.

What is claimed is:

1. A multilayer coil component comprising:

a multilayer body that is formed by stacking a plurality of insulating layers on top of one another and that has a coil built into the inside thereof, the coil being formed by electrically connecting a plurality of coil conductors, which are stacked together with insulating layers, to one another, and the multilayer body has a first end surface and a second end surface, which face each other in a length direction, a first main surface and a second main surface, which face each other in a height direction perpendicular to the length direction, the first main surface being a mounting surface, a stacking direction of the multilayer body and an axial direction of the coil being parallel to the mounting surface, the coil conductors overlap in a plan view from the stacking direction, and distances between adjacent coil conductors are not constant in a side view from a direction perpendicular to the stacking direction, and a first side surface and a second side surface, which face each other in a width direction perpendicular to the length direction and the height direction;

a first outer electrode and a second outer electrode that are electrically connected to the coil, the first outer electrode being arranged so as to cover only a part of the first end surface such that another part of the first end surface is exposed and so as to extend from the first end surface and cover part of the first main surface, and the second outer electrode being arranged so as cover only a part of the second end surface such that another part of the second end surface is exposed and so as to extend from the second end surface and cover part of the first main surface; and a first connection conductor and a second connection conductor inside the multilayer body;

wherein the first connection conductor is connected in a straight line between a part of the first outer electrode that covers the first end surface and the coil conductor that faces the first outer electrode, the second connection conductor is connected in a straight line between a part of the second outer electrode that covers the second end surface and the coil conductor that faces the second outer electrode, and the first connection conductor and the second connection conductor overlap the coil conductors in a plan view from the stacking direction and are located closer to the mounting surface than a center axis of the coil.

2. The multilayer coil component according to claim 1, wherein the distances between adjacent coil conductors increase in a direction from the first end surface toward the second end surface.

3. A multilayer coil component comprising:

a multilayer body that is formed by stacking a plurality of insulating layers on top of one another and that has a coil built into the inside thereof, the coil being formed by electrically connecting a plurality of coil conductors, which are stacked together with insulating layers, to one another, and the multilayer body has a first end surface and a second end surface, which face each other in a length direction, a first main surface and a second main surface, which face each other in a height direction perpendicular to the length direction, the first main surface being a mounting surface, a stacking direction of the multilayer body and an axial direction of the coil being parallel to the mounting surface, the coil conductors overlap in a plan view from the stacking direction, and distances between adjacent coil conductors are not constant in a side view from a direction perpendicular to the stacking direction, and a first side surface and a second side surface, which face each other in a width direction perpendicular to the length direction and the height direction;

a first outer electrode and a second outer electrode that are electrically connected to the coil, the first outer electrode being arranged so as to cover part of the first end surface and so as to extend from the first end surface and cover part of the first main surface, and the second outer electrode being arranged so as to cover part of the second end surface and so as to extend from the second end surface and cover part of the first main surface; and a first connection conductor and a second connection conductor inside the multilayer body;

wherein the first connection conductor is connected in a straight line between a part of the first outer electrode that covers the first end surface and the coil conductor that faces the first outer electrode, the second connection conductor is connected in a straight line between a part of the second outer electrode that covers the second end surface and the coil conductor that faces the second outer electrode, the first connection conductor and the second connection conductor overlap the coil conductors in a plan view from the stacking direction and are located closer to the mounting surface than a center axis of the coil, and a length of the coil in the length direction lies in a range of around 85.0% to 94.0% of a length of the multilayer body.

4. The multilayer coil component according to claim 2, wherein a length of the coil in the length direction lies in a range of around 85.0% to 94.0% of a length of the multilayer body.

* * * * *